US009268261B2

(12) United States Patent
Handa et al.

(10) Patent No.: US 9,268,261 B2
(45) Date of Patent: Feb. 23, 2016

(54) DEVELOPING DEVICE FOR PREVENTING TONER LEAKAGE

(71) Applicants: Hiroshi Handa, Inazawa (JP); Hiroki Mori, Nagoya (JP)

(72) Inventors: Hiroshi Handa, Inazawa (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/091,361

(22) Filed: Nov. 27, 2013

(65) Prior Publication Data

US 2014/0153959 A1 Jun. 5, 2014

(30) Foreign Application Priority Data

Nov. 30, 2012 (JP) ..... 2012-263418

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
USPC ..... 399/103
See application file for complete search history.

(56) References Cited

U.S. PATENT DOCUMENTS 5,552,868 A * 9/1996 Iwama et al. ..... 399/286
6,907,207 B2 * 6/2005 Shoji et al. ..... 399/103
7,333,746 B2 2/2008 Nagata et al.
7,623,815 B2 * 11/2009 Mori et al. ..... 399/284
2003/0118364 A1 6/2003 Kamimura
2007/0242973 A1 10/2007 Yaji
2009/0317144 A1 * 12/2009 Koido ..... 399/284
2010/0150603 A1 6/2010 Sakamoto et al.
2011/0064454 A1 * 3/2011 Xu et al. ..... 399/103
2011/0236057 A1 * 9/2011 Nakajima et al. ..... 399/103
2013/0051840 A1 2/2013 Yamamoto et al.

FOREIGN PATENT DOCUMENTS

JP 2006-201591 A 8/2006
JP 2011-203298 A 10/2011

OTHER PUBLICATIONS

Co Pending U.S. Appl. No. 14/091,362, filed Nov. 27, 2013.
Nov. 4, 2014—(US) Non-Final Office Action—U.S. Appl. No. 14/091,362.

* cited by examiner

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

A developing device includes a frame, a developing roller, a blade unit, and a first seal member. A blade unit extends in an axial direction of the developing roller and in contact with the peripheral surface thereof. The first seal member is configured to seal a boundary between the frame and the axial end portions of the developing roller. The frame has a fixing portion to which end portions of the blade is fixed. The fixing portion has a support surface having an outer edge and an inner edge in the axial direction. The outer edge is positioned outward of an inner edge of the first seal member in the axial direction, and the inner edge of the support surface is positioned inward of the inner edge of the first seal member in the axial direction.

9 Claims, 5 Drawing Sheets

DEVELOPING DEVICE FOR PREVENTING TONER LEAKAGE

CROSS REFERENCE TO RELATED APPLICATION

This application claims priority from Japanese Patent Application No. 2012-263418 filed Nov. 30, 2012, the entire content of which is incorporated herein by reference.

TECHNICAL FIELD

The present invention relates to a developing device in an image forming device, and more particularly, to such device having a seal member and a layer thickness regulation blade.

BACKGROUND

Japanese Patent Application Publication No. 2011-203298 discloses a developing device including a cartridge frame for accommodating therein developing agent, a developing roller, a seal having a side seal member for sealing an axial end portion of the developing roller, and a blade unit having a layer thickness regulation blade for regulating a thickness of a layer of the developing agent carried on a peripheral surface of the developing roller.

The cartridge frame has a support surface formed with a fixing hole for fixing a longitudinal end portion of the blade unit by a thread threadingly engaged with the fixing hole. The support surface is positioned outward of an inner edge of the side seal member in the longitudinal direction of the blade unit. That is, the support surface is positioned outward of the blade unit in the longitudinal direction thereof.

SUMMARY

According to the developing device disclosed in the JP publication, since the support surface for fixing the end portion of the blade unit is positioned outward of the inner end of the side seal member, contacting pressure of the blade unit with respect to the peripheral surface of the developing roller may be lowered at the portion adjacent to the inner end of the side seal member. As a result, leakage of the developing agent may occur through a gap between the longitudinal end portion of the developing roller and the blade at a position adjacent to the inner end of the side seal member.

In view of the foregoing, it is an object of the invention to provide a developing device capable of restraining leakage of the developing agent through the blade and the longitudinal end portion of the developing roller.

In order to attain the above and other objects, the invention provides a developing device including a frame, a developing roller, a blade unit, and a first seal member. The developing roller is rotatable about an axis that defines an axial direction, and has a peripheral surface on which a layer of the developing agent is configured to be formed. The developing roller has axial end portions. The blade unit extends in the axial direction and in contact with the peripheral surface of the developing roller. The blade is configured to regulate a thickness of the layer of the developing agent on the peripheral surface. The blade unit has end portions in the axial direction. The first seal member is configured to seal a boundary between the frame and the axial end portions. The first seal member has an inner edge in the axial direction. The frame includes a fixing portion to which the end portions of the blade are fixed. The fixing portion has a support surface facing to the developing roller, and the support surface has an outer edge and an inner edge in the axial direction. The outer edge of the support surface is positioned outward of the inner edge of the first seal member in the axial direction, and the inner edge of the support surface is positioned inward of the inner edge of the first seal member in the axial direction.

DETAILED DESCRIPTION

Figure 1:
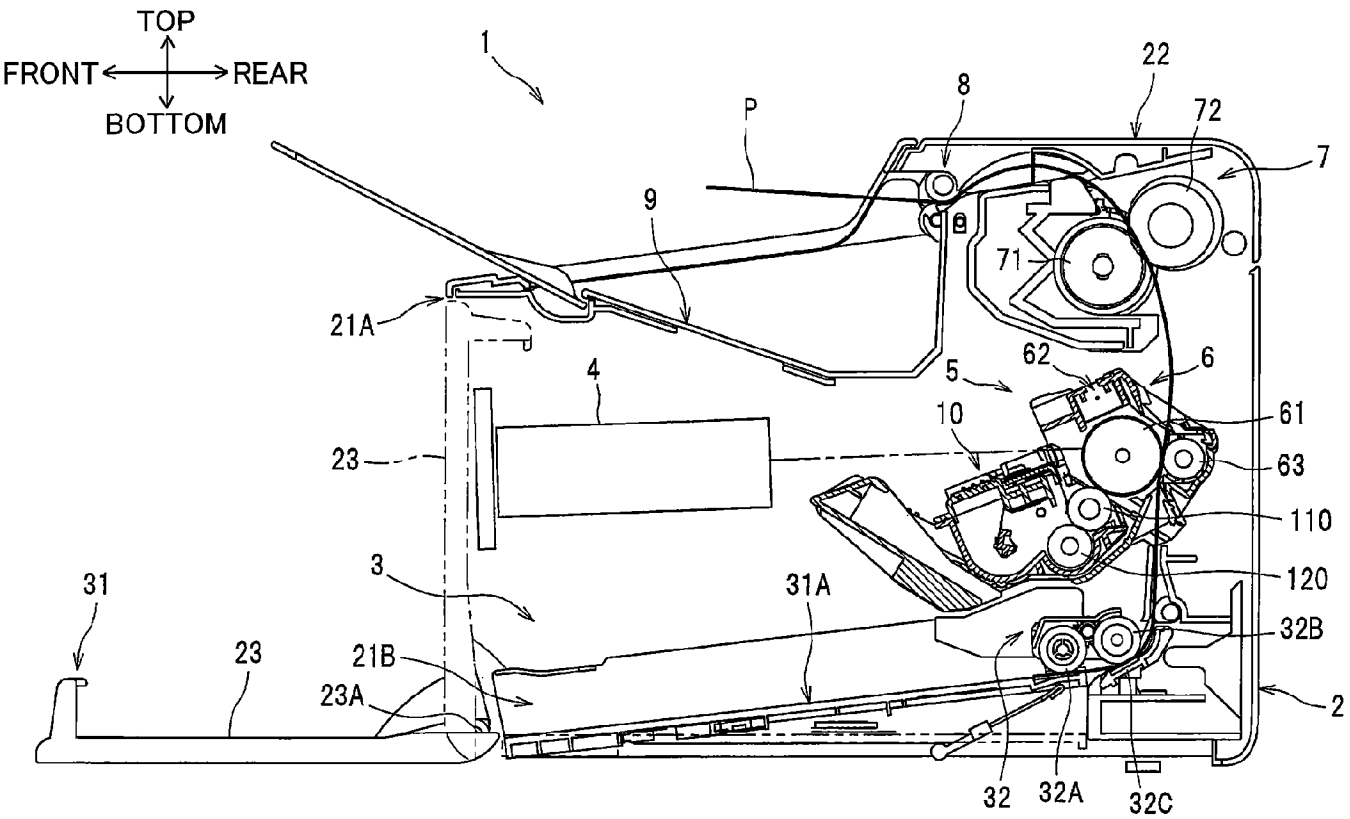
FIG. 1 is a schematic cross-sectional side view of a laser printer provided with a developing device according to one embodiment of the present invention.

A developing device according to one embodiment of the present invention will be described with reference to FIGS. 1 through 5. The developing device according to the embodiment constitutes a developing cartridge 10 configured to be accommodated in a process cartridge 5 shown in FIG. 2 in a laser printer 1 shown in FIG. 1. The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1 in which left side and right of FIG. 1 will be referred to as a "front side" and a "rear side" respectively. Further, a direction perpendicular to frontward/rearward direction will be referred to as "lateral direction" or "leftward/rightward direction", and a direction perpendicular to the frontward/rearward direction and to the lateral direction will be referred to as "vertical direction".

[Overall Structure of the Laser Printer]

As shown in FIG. 1, the laser printer 1 includes a main casing 2, a feeder unit 3, a scanner unit 4, a process cartridge 5 configured to form a toner image on a sheet P, and a fixing unit 7 for thermally fixing the toner image to the sheet P.

The main casing 2 includes a top cover 22 and a front cover 23, and has a front end formed with an opening 21A for attachment and detachment of the process cartridge 5. Further, a sheet insertion portion 21B is provided at a lower portion of the opening 21A for inserting a sheet P.

The front cover 23 is pivotally movably supported to a lower front end portion of the main casing 2 by a pivot shaft 23A, such that the front cover 23 is movable to an upstanding position closing the opening 21A as indicated by two dotted chain line and to a lying position opening the opening 21A as indicated by a solid line.

The feeder unit 3 is positioned at a lower interior space of the main casing 2, and includes a sheet supply tray 31 for accommodating a stack of sheets P, and a sheet supply mechanism 32 configured to supply the sheet in the sheet supply tray 31. The sheet supply tray 31 is constituted by a sheet stand 31A positioned at the lower portion of the main casing 2 and the front cover 23 opened in continuous manner with the sheet stand 31A.

The sheet supply mechanism 32 includes a sheet supply roller 32A, a separation roller 32B, and a separation pad 32C. The sheet supply roller 32A is positioned upward of a rear end portion of the sheet stand 31A. The separation roller 32B is positioned downstream of the sheet supply roller 32A in a sheet feeding direction. The separation pad 32C is positioned in confrontation with the separation roller 32B such that the sheet P is nipped therebetween.

In the feeder unit 3, the sheet P mounted on the upper surface of the lying front cover 23 and on the sheet stand 31A is supplied toward the separation roller 32B by the rotation of the sheet supply roller 32A. Then, an uppermost sheet P is separated from the remaining sheets of the sheet stack by the separation roller 32B and the separation pad 32C, and is supplied toward the process cartridge 5.

The scanner unit 4 is positioned at a front side of the inner space of the main casing 2, and includes a laser emitting portion, a polygon mirror, a lens and a reflection mirror those not shown. The scanner unit 4 is configured to emit laser beam to an outer peripheral surface of a photosensitive drum 61 (described later) with high speed scanning.

Figure 2:
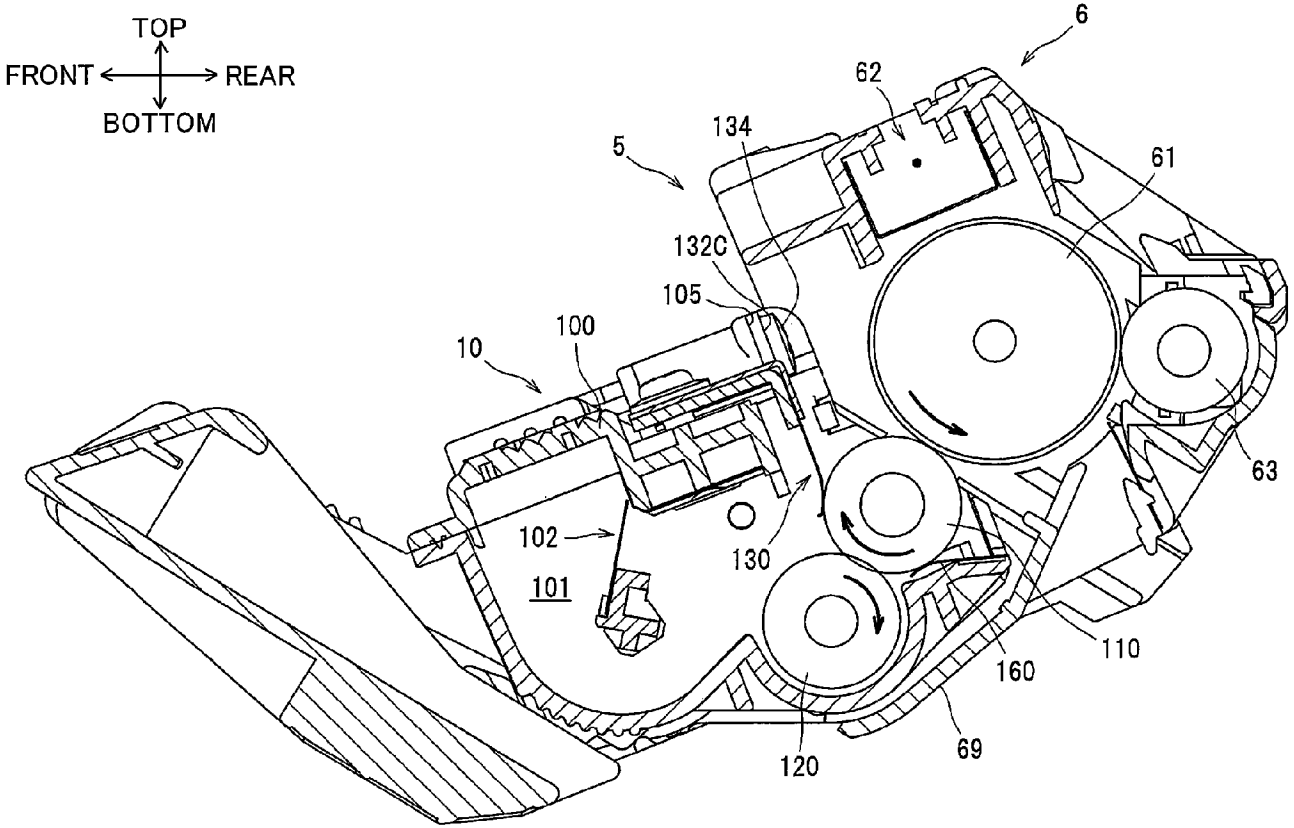
FIG. 2 is an enlarged cross-sectional view of a process cartridge including the developing device according to the embodiment.

The process cartridge 5 is positioned above the sheet supply mechanism 32 at a rear side of and a widthwise center of the internal space of the main casing 2. The process cartridge 5 can be detached from and attached to the main casing 2 through the opening 21A. As shown in FIG. 2, the process cartridge 5 includes a drum unit 6 and a developing cartridge 10 as the developing device.

The drum unit 6 includes a drum frame 69, the photosensitive drum 61, a charger 62 and a transfer roller 63 those provided in the drum frame 69. The developing cartridge 10 is detachably attachable to the drum unit 6, and includes a frame 100, a developing roller 110, a supply roller 120, and a blade unit 130 for regulating a thickness of a layer of developing agent.

The developing roller 110 is configured to carry developing agent (toner) on its peripheral surface. The developing roller 110 is rotatable about its axis and is supported to the frame 100. The supply roller 120 is configured to supply toner carried on its peripheral surface to the peripheral surface of the developing roller 110. The supply roller 120 is positioned diagonally frontward and downward of the developing roller 110 in an accommodated state of the process cartridge 5 to the main casing 2. The supply roller 120 extends in a direction parallel to an axial direction of the developing roller 110.

The frame 100 defines a toner chamber 101 in which an agitator 102 is rotatably provided for agitating toners accommodated in the toner chamber 101. After the toner in the toner chamber 101 is subjected to agitation by the agitator 102, the toner is supplied from the peripheral surface of the supply roller 120 to the peripheral surface of the developing roller 110. In this case, the toner is tribocharged with positive polarity between the peripheral surfaces of the supply roller 120 and the developing roller 110. Then, the toner carried on the peripheral surface of the developing roller 110 is entered into a space between the blade unit 130 and the peripheral surface of the developing roller 110 while being subjected to triboelectric charging in accordance with the rotation of the developing roller 110. Thus, the toner layer having a uniform thickness is carried on the peripheral surface of the developing roller 110.

In the drum unit 6, after the peripheral surface of the rotating photosensitive drum 61 is uniformly charged by the charger 62, the surface of the photosensitive drum 61 is exposed to laser beam with high speed scanning by the scanner unit 4. Thus, electric potential of the exposed region of the photosensitive drum 61 is lowered to provide an electrostatic latent image based on image data on the peripheral surface of the photosensitive drum 61.

Accordingly, toner image corresponding to the electrostatic latent image is formed on the peripheral surface of the photosensitive drum 61 by supplying toner from the developing roller 110. Thereafter, the toner image on the photosensitive drum 61 is transferred onto the sheet P when the sheet P passes through a gap between the photosensitive drum 61 and the transfer roller 63 to which a transfer bias is applied.

The fixing unit 7 is positioned at an upper rear portion of the internal space of the main casing 2 and above the process cartridge 5, and includes a heat roller 71 and a pressure roller 72. The heat roller 71 is adapted to heat the sheet P, and has an internal space provided with a heat source such as a halogen lamp (not shown). The pressure roller 72 is positioned diagonally rearward and upward of the heat roller 71 and adapted to nip the sheet P in cooperation with the heat roller 71. A discharge roller 8 is positioned downstream of the fixing unit 7 in the sheet feeding direction, and a discharge tray 9 is provided at an upper portion of the main casing 2.

The toner image formed on the sheet P is thermally fixed to the sheet P when the sheet P passes through a gap between the heat roller 71 and the pressure roller 72. The sheet P is then conveyed to the discharge tray 9 by the discharge roller 8.

[Detailed Structure of the Developing Cartridge]

Figure 3:
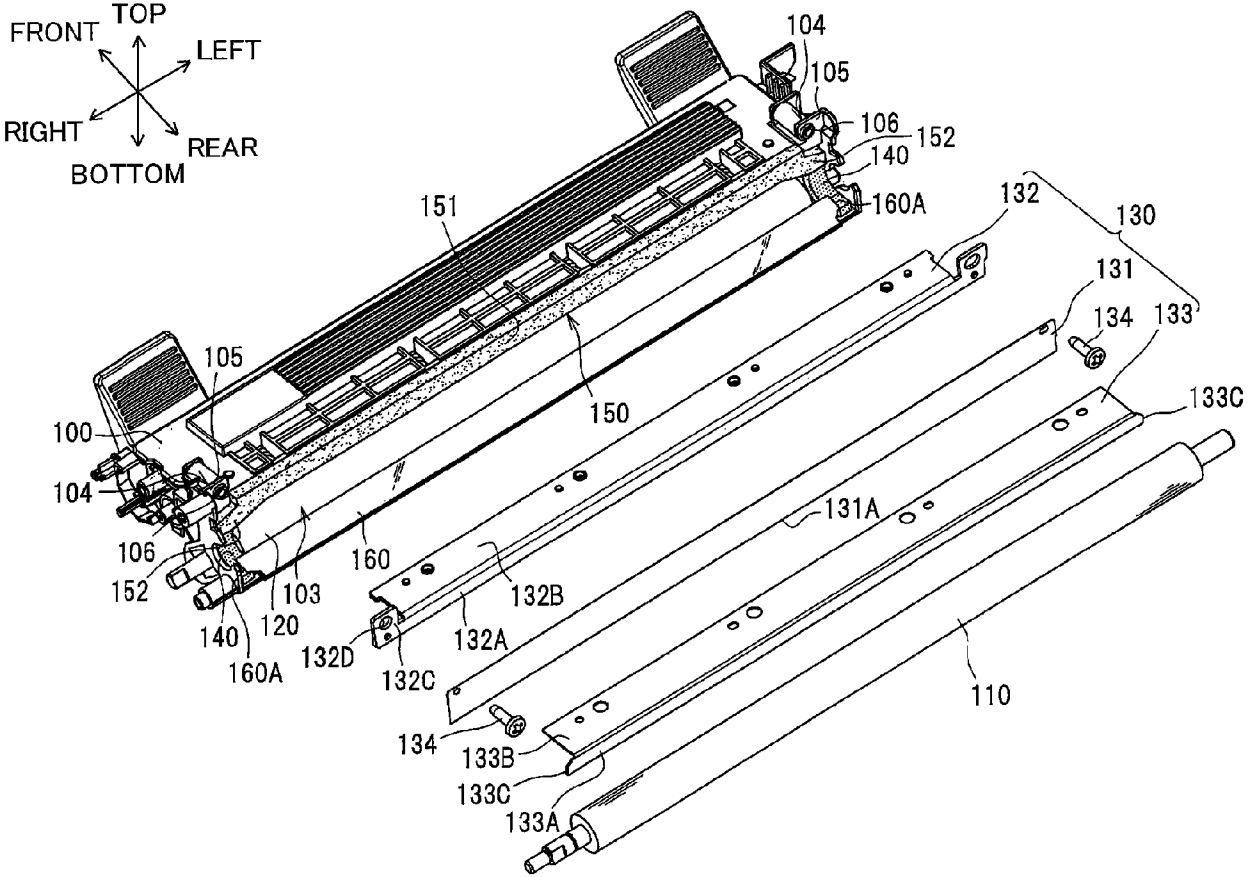
FIG. 3 is an exploded perspective view of the developing cartridge according to the embodiment.

Details of the frame 100 and the blade unit 130 of the developing cartridge 10 will be described. As shown in FIG. 3, the frame 100 has a rear side wall formed with a rectangular opening 103, and the developing roller 110 and the blade unit 130 are attached to the frame 100 such that the developing roller 110 and the blade unit 130 close the opening 103. Side seal members 140, an upper seal member 150, and a film 160 are provided around a rectangular perimeter of the opening 103 to prevent the toner in the frame 100 from being leaked out of the frame 100.

Figure 4:
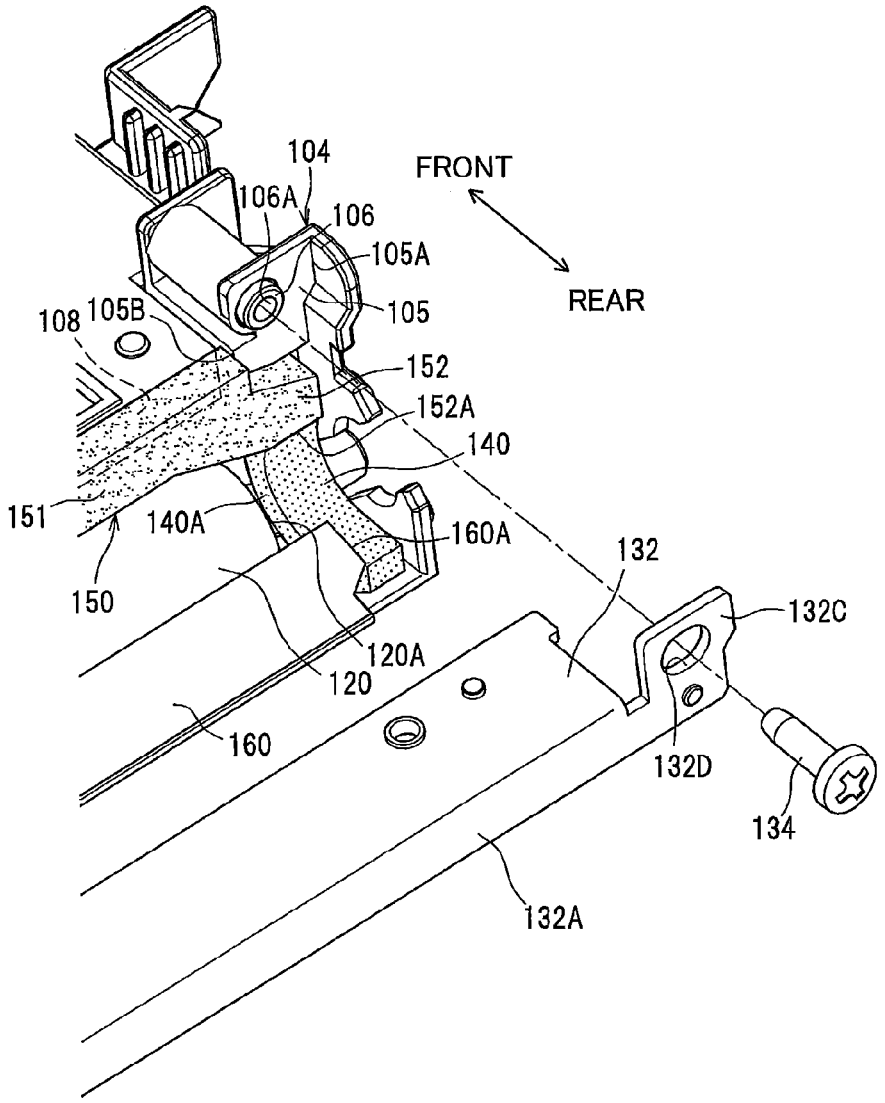
FIG. 4 is an enlarged partial perspective view of a left end portion of a cartridge frame in the developing device according to the embodiment.
Figure 5:
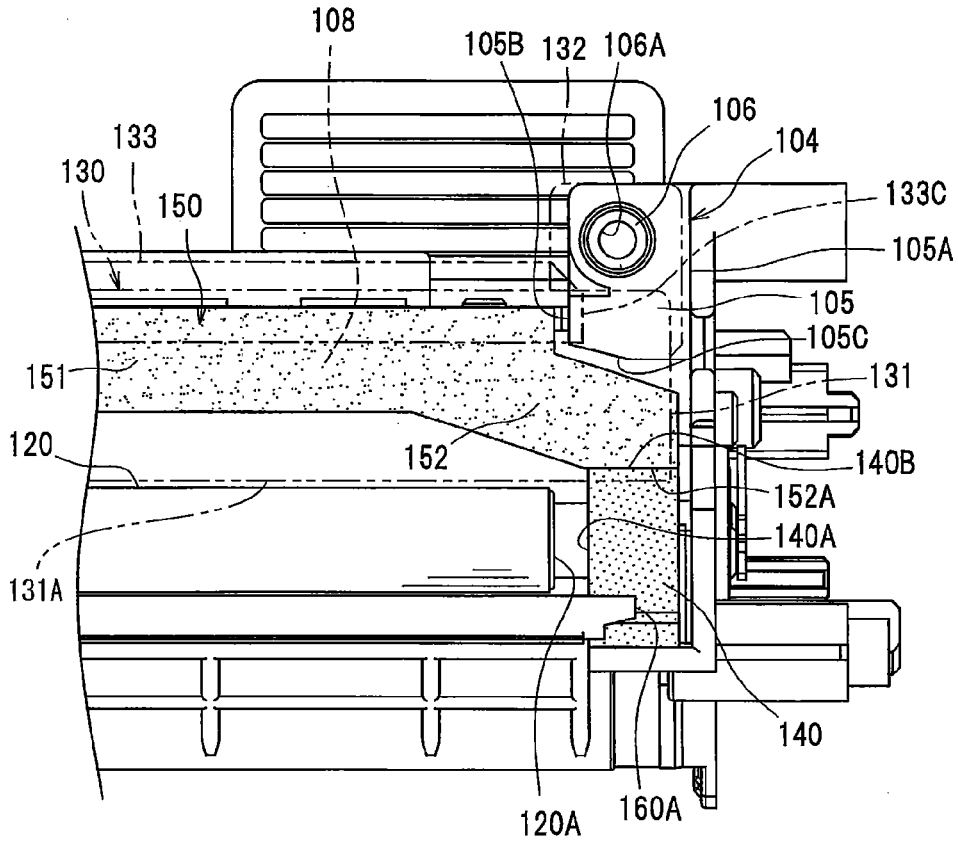
FIG. 5 is an enlarged partial rear view of the left end portion of the cartridge frame in the developing device according to the embodiment.

A fixing portion 104 is provided at each upper end portion of an upper edge of the opening 103 for fixing the blade unit 130. Each fixing portion 104 has a support surface 105 facing rearward. A boss 106 formed with a female thread hole 106A is provided at the support surface 105. Further, an attachment surface 108 is provided at the upper edge portion of the opening 103 and at a position frontward of the fixing portion 104 in frontward/rearward direction of the frame 100 for fixing the upper seal member 150 to the attachment surface 108 shown in FIG. 4. The attachment surface 108 faces rearward and extends in leftward/rightward direction of the frame 100 to a portion adjacent to and above a portion where the side seal member 140 is provided, i.e., as shown in FIG. 5, an end portion of the attachment surface 108 in the leftward/rightward direction is overlapped with the side seal member 140 as viewed from frontward/rearward direction.

The blade unit 130 includes a blade body 131 as a first plate-like member, a blade holder 132, and a reinforcing plate 133 as a second plate-like member. The blade body 131 is formed of a metal plate such as a stainless steel plate, and has a free end portion functioning as a contact portion 131A. The free end portion of the contact portion 131A is bent or curved (see FIG. 2) and is in confrontation with and in contact with the peripheral surface of the developing roller 110. Because of this curved contact portion 131A, the blade body 131 regulates a thickness of the toner layer formed on the developing roller 110 into a uniform thickness.

The blade holder 132 includes a blade support section 132A for supporting the blade body 131, a reinforced section 132B to which the reinforcing plate 133 is attached, and a pair of attachment sections 132C to be attached to the pair of fixing portions 104 of the frame 100. The reinforced section 132B is bent frontward at substantially right angle with respect to the blade support section 132A from an upper edge thereof. Each attachment section 132C is provided at each longitudinal end portion of the blade holder 132 such that each attachment section 132C can be superposed with each support surface 105 of each fixing portion 104 in frontward/rearward direction. Each attachment section 132C protrudes upward from each longitudinal end portion of the blade support section 132A. The longitudinal end portion is an end portion of the blade support section 132A in rightward/leftward direction. Further, each attachment section 132C is formed with a through-hole 132D penetrating the same in the frontward/rearward direction.

The reinforcing plate 133 includes a nip section 133A, a fixing section 133B, and a longitudinal end portion 133C. The nip section 133A is adapted to nip the blade body 131 in cooperation with the blade support section 132A of the blade holder 132. The fixing section 133B is adapted to be fixed to the reinforced section 132B of the blade holder 132. The nip section 133A is bent downward at substantially right angle with respect to the fixing section 133B from a rear edge thereof. The nip section 133A of the reinforcing plate 133 has longitudinal ends each being superposed with the support surface 105 in the frontward/rearward direction.

The blade body 131 is nipped between the blade support section 132A of the blade holder 132 and the nip section 133A of the reinforcing plate 133, and the reinforced section 132B of the blade holder 132 and the fixing section 133B of the reinforcing plate 133 are fixed together by threads (not shown), to thus provide an integral blade unit 130. As shown in FIG. 4, each thread 134 extends through each through-hole 132D of the attachment section 132C of the blade holder 132, and the thread 134 is threadingly engaged with each female thread of the boss 106 at the fixing portion 104. Thus, the blade unit 130 is fixed to the frame 100.

The side seal members 140 are adapted to perform sealing between the frame 100 and axial end portions of the developing roller 110. Each side seal member 140 is arcuate in shape in conformance with an outer peripheral shape of the developing roller 110. The side seal member 140 includes a base layer attached to the frame 100 and a sliding layer formed on the base layer and in sliding contact with the peripheral surface of the developing roller 110. The base layer is formed of a sponge member made from urethane foam or a silicone sponge. The sliding layer is formed of a woven fabric for trapping the toner, and has a fluffed surface. PTFE (polytetrafluoroethylene) fiber, PET (polyethylene terephthalate) fiber, acrylic fiber, and nylon fiber are available as a material of the sliding layer.

The upper seal member 150 is adapted to perform sealing between the frame 100 and the blade unit 130 along a length of the blade unit 130 and is formed of a sponge member such as urethane foam. The upper seal member 150 includes a central portion 151 elongated in a rightward/leftward direction, and contact portions 152 each extending diagonally downward from each longitudinal end portion of the central portion 151 and in contact with each side seal member 140. The central portion 151 and the contact portions 152 are integral with each other. As shown in FIG. 5, the contact portion 152 has a lower edge 152A linearly extending in horizontal direction, and the lower edge 152A is in contact with a linearly extending upper edge 140B of the side seal member 140. Since the upper edge 140B of the side seal member 140 and the lower edge 152A of the contact portion 152 extend linearly, this contacting relationship can prevent the toner from leaking from a boundary between the upper seal member 150 and the side seal member 140. The upper seal member 150 is adhesively bonded to the attachment surface 108 of the frame 100, such that the upper seal member 150 is nipped between the attachment surface 108 and the blade support section 132A of the blade holder 132.

The film 160 is formed of a resin material such as PET, acrylic resin and fluorine resin. The film 160 extends in the axial direction of the developing roller 110. The film 160 has a base end portion attached to the frame 100, and a free end portion directing toward an internal space of the frame 100 and in sliding contact with the peripheral surface of the developing roller 110. The film 160 is positioned below the developing roller 110 and upstream of the blade unit 130 in the rotational direction of the developing roller 110.

[Details of Lateral End Portions of the Developing Cartridge]

Lateral end portions of the developing cartridge are end portions thereof in rightward/leftward direction. Since the right end portion and left end portion of the developing cartridge 10 are symmetrical with each other, only the left end portion will be described.

As shown in FIGS. 3, 4 and 5, the support surface 105 of the fixing portion 104 extends in vertical direction and faces to the developing roller 110. Further, the support surface 105 extends approximately parallel to the attachment surface 108 of the frame 100. The boss 106 formed with the female thread hole 106A protrudes rearward from the support surface 105. The boss 106 is positioned at substantially lateral center portion of the support surface 105, and is deviated upward. Thus, the thread hole 106A and a part of the support surface 105 is positioned higher than the attachment surface 108. Further, the support surface 105 is positioned rearward of the attachment surface 108 in the frontward/rearward direction. That is, the support surface 105 is closer to the developing roller 110 than the attachment surface 108 to the developing roller 110.

The support surface 105 of the frame 100 has an outer edge 105A and an inner edge 105B in the lateral direction of the frame 100 (in the longitudinal direction of the blade unit 130), and the side seal member 140 has an inner edge 140A in the lateral direction (in the axial direction of the developing roller 110). The outer edge 105A is positioned outward of the inner edge 140A in the lateral direction. Further, the inner edge 105B of the support surface 105 is positioned outside of an image forming region in the axial direction of the developing roller 110, and inward of the inner edge 140A of the side seal member 140. The image forming range is positioned inward of the axial ends of the supply roller 120 in the axial direction thereof.

More specifically, the inner edge 105B of the support surface 105 is positioned between an axial end surface 120A of the supply roller 120 and the inner edge 140A of the side seal member 140. Further, the inner edge 105B is positioned inward of a longitudinal end 160A of the film 160 in the longitudinal direction thereof.

Further, the support surface 105 has an inclined lower edge 105C connected to the inner edge 105B. The inclined lower edge 105C is inclined so as to gradually away from an edge of the contact portion 131A toward a longitudinal center of the blade unit 130.

[Function]

In the developing cartridge 10 thus constructed, since the support surface 105 is positioned rearward of the attachment surface 108 to which the upper seal member 150 is attached, the upper seal member 150 can be nipped with a desirable compressed state between the blade support section 132A and the attachment surface 108 of the frame 100, and the blade support section 132A can be fixed to the support surface 105 with a sufficient contacting state therewith without any floating of the longitudinal end portion of the blade support section 132A.

Here, the inner edge 105B of the support surface 105 is positioned between the axial end 120A of the supply roller 120 and the inner edge 140A of the side seal member 140. In other words, the support surface 105 is positioned to superpose with inner edge 140A of the side seal member 140 that performs sealing between the frame 100 and the axial end portion of the developing roller 110 in the longitudinal direction of the blade unit 130. Therefore, the contact portion 131A of the blade body 131 can be in contact with the peripheral surface of the developing roller 110 with a sufficient contacting pressure at a position adjacent to the inner edge 140A of the side seal member 140. Consequently, sufficient triboelectric charging to the toner occurs at a position between the peripheral surface of the developing roller 110 and the contact portion 131A of the blade body 131, which can restrain toner leakage from a boundary between each axial end portion of the developing roller 110 and the blade body 131 of the blade unit 130.

Further, the inner edge 105B of the support surface 105 is positioned inward of the longitudinal end 160A of the film 160. Therefore, a supported part of the blade unit 130 supported by the support surface 105 can sufficiently perform toner scraping with respect to a confronting area of the developing roller 110, the confronting area being in confrontation with the supported part of the blade unit 130, so that the toner layer thickness at the confronting area can be sufficiently regulated. Consequently, a corresponding portion of the film 160 corresponding to the support surface 105 does not sufficiently perform toner scraping with respect to the confronting area of the developing roller 110. As a result, amount of toner scraped by the film 160 is sufficiently small, and toner leakage out of the frame 100 through the film 160 can be reduced.

Further, since the longitudinal end portion 133C of the reinforcing plate 133 is positioned to superpose with the support surface 105 when viewed from frontward/rearward direction so as to nip the end portion of the blade body 131 in cooperation with the support surface 105, the longitudinal end portions of the contact portion 131A of the blade body 131 can be in contact with the peripheral surface of the developing roller 110 with a sufficient contacting pressure. Accordingly, toner leakage out of the boundary between the blade body 131 and the axial end portions of the developing roller 110 can be prevented ore restrained.

Further, since the inner edge 105B of the support surface 105 is positioned outward of the axial end portion 120A of the supply roller 120, toner can be sufficiently supplied from the supply roller 120 to the developing roller 110 even at the axial end portion 120A of the supply roller 120.

Further, the inclined lower edge 105C is inclined away from the contact portion 131A in a direction toward the longitudinal center of the blade unit 130. Therefore, at the axial end portions of the developing roller 110, contacting pressure of the contact portion 131A with respect to the peripheral surface of the developing roller 110 can be gradually reduced without abrupt change toward the longitudinal center of the blade unit 130. Consequently, toner leakage out of the boundary between the blade body 131 and the axial end portions of the developing roller 110 can be stably restrained.

As described above, in the developing cartridge 10 according to the present embodiment, sufficient contacting pressure of the free end portion of the blade body 131 relative to the peripheral surface of the developing roller 110 can be provided at positions adjacent to two side seal members 140 that seal the boundary between the frame 100 and the axial end portions of the developing roller 110. Therefore, leakage of the toner from the boundary between the free end portion of the blade body 131 and the axial end portions of the developing roller 110 can be restrained.

Various modifications are conceivable. For example, the developing device according to the present invention is available not only to a monochromatic printer shown in FIG. 1 but also to other image forming device such as a color printer, a copying machine and a multi-function device. The frame 100 of the developing cartridge 10 accommodates therein the toner. The developing cartridge may detachably receive a toner cartridge for accommodating toner therein.

While the invention has been described in detail with reference to the above-described embodiments thereof, it would be apparent to those skilled in the art that various changes and modifications may be made therein without departing from the spirit of the invention.

What is claimed is:

1. A developing device comprising:

a frame;

a developing roller rotatable about an axis that defines an axial direction, and having a peripheral surface on which a layer of developing agent is configured to be formed, the developing roller having axial end portions;

a blade unit extending in the axial direction and in contact with the peripheral surface of the developing roller, the blade unit being configured to regulate a thickness of the layer of the developing agent on the peripheral surface of the developing roller, the blade unit having end portions in the axial direction;

a first seal member configured to seal a boundary between the frame and the axial end portions, the first seal member having an inner edge in the axial direction; and a second seal member extending in the axial direction and configured to seal a boundary between the frame and the blade unit, wherein the frame comprises a fixing portion to which the end portions of the blade unit are fixed, the fixing portion having a support surface facing the developing roller, the support surface having a boss formed with a thread hole into which a screw for fixing the blade unit to the fixing portion is inserted, and the support surface having an outer edge and an inner edge in the axial direction, the outer edge of the support surface being positioned outward of the inner edge of the first seal member in the axial direction, and the inner edge of the support surface and at least a part of the boss being positioned inward of the inner edge of the first seal member in the axial direction, wherein the blade unit comprises:

a blade body in contact with the developing roller; and a blade holder positioned opposite to the developing roller with respect to the blade body, the blade holder comprising:

a blade support section in contact with the blade body, and an attachment section formed with a through hole in which the boss is positioned, the attachment section protruding from the blade support section in a direction away from the developing roller, wherein the frame has an attachment surface to which the second seal member is attached, the attachment surface being positioned inward of the support surface in the axial direction, the support surface protruding closer to the developing roller than the attachment surface is to the developing roller, and wherein the inner edge of the support surface is positioned between the boss and the first seal member in a direction perpendicular to the axial direction and in parallel to the support surface, the inner edge of the support surface contacting the blade support section.

2. The developing device as claimed in claim 1, further comprising a supply roller extending in the axial direction in parallel to the developing roller, the supply roller being configured to supply developing agent to the developing roller, the supply roller having an axial end surface in the axial direction, and the inner edge of the support surface being positioned outward of the axial end surface of the supply roller in the axial direction.

3. The developing device as claimed in claim 1, further comprising a film extending in the axial direction and having a base end portion fixed to the frame and a free end portion in sliding contact with the peripheral surface of the developing roller, the film being positioned upstream of the blade unit in a rotational direction of the developing roller, and the film having a longitudinal end in the axial direction, and wherein the frame is formed with an opening at which the developing roller and the film are provided, the inner edge of the support surface being positioned inward of the longitudinal end of the film.

4. The developing device as claimed in claim 1, wherein the blade unit comprises:

a first plate like member in contact with the peripheral surface of the developing roller, and a second plate like member holding the first plate like member and extending in the axial direction and having a longitudinal end portion in the axial direction, the longitudinal end portion of the second plate like member being positioned to superpose with the support surface when viewed in a direction perpendicular to the support surface.

5. The developing device as claimed in claim 4, wherein the first plate like member has a contact portion in contact with the peripheral surface of the developing roller, the support surface has an edge line inclined in a direction gradually away from the contact portion toward the inner edge of the support surface.

6. The developing device as claimed in claim 4, wherein the first plate like member is made from a stainless steel.

7. The developing device as claimed in claim 1, wherein the developing roller is configured to provide an image forming region, the support surface being positioned outside of the image forming region in the axial direction.

8. The developing device as claimed in claim 1, wherein the fixing portion comprises a thread fixing portion provided at the support surface, the blade unit being fixed to the thread fixing portion.

9. The developing device as claimed in claim 1, wherein the second seal member has an outer edge in the axial direction, and wherein the inner edge of the support surface is positioned inward of the outer edge of the second seal member in the axial direction.

* * * * *